United States Patent [19]

Evans et al.

[11] Patent Number: 4,836,428

[45] Date of Patent: Jun. 6, 1989

[54] MAIL BAG STRUCTURE

[75] Inventors: Richard C. Evans; William S. Schell, both of Louisville, Ky.

[73] Assignee: Kally, Inc., Louisville, Ky.

[21] Appl. No.: 764,303

[22] Filed: Aug. 12, 1985

[51] Int. Cl.[4] ..... B65D 13/00

[52] U.S. Cl. ..... 224/253; 224/240

[58] Field of Search ..... 224/151, 253, 240, 269; 2/311; D2/627, 628, 629, 630; D11/4, 5; 150/52 J; 190/127, 107

[56] References Cited

U.S. PATENT DOCUMENTS

| | | | |
|---|---|---|---|
| 1,716,689 | 6/1929 | Freemark | D2/628 X |
| 2,295,143 | 9/1942 | Watkins | 224/253 |
| 2,474,495 | 6/1949 | Pollak | 224/240 |
| 2,590,187 | 3/1952 | Langos | 224/253 |
| 2,914,070 | 11/1959 | Kellner et al. | 2/311 |
| 3,276,646 | 10/1966 | Coggin, Jr. | 224/253 X |
| 4,119,249 | 10/1978 | Hanson | 224/253 |
| 4,210,230 | 7/1980 | Weiner | 190/43 |
| 4,424,841 | 1/1984 | Smith | 150/33 |
| 4,515,300 | 5/1985 | Cohen | 224/253 |

FOREIGN PATENT DOCUMENTS 1294937 4/1902 France .

*Primary Examiner*—Henry J. Recla
*Assistant Examiner*—Robert Fetsuga
*Attorney, Agent, or Firm*—Jon C. Winger

[57] ABSTRACT

A bag structure particularly adapted for carrying a heavy load, such as mail and the like, at the waist to either side of the body. The bag includes a mail container constructed of a heavy, wear-resistant material such as, for example, canvas. The bag has a front wall, a back wall spaced from the front wall, spaced apart end walls interconnecting the front and back walls, a floor, and an open top. A belt is adapted to be attached to the mail container and releasably wrap around the waist of a person to carry the container. A belt loop device is located at the back wall of the container for removably attaching the belt to the exterior surface of the container back wall.

10 Claims, 3 Drawing Sheets

MAIL BAG STRUCTURE

BACKGROUND OF THE INVENTION

1. Field of the Invention

This invention relates to body-attachable bags for transporting articles, and more particularly, to a mail bag structure worn at the human waist to either side of the body.

2. Description of the Prior Art

Known mail bag structures use a shoulder strap for carrying the bag structure. The strap is worn over the shoulder with the container suspended from the depending ends of the shoulder strap. Mail carriers must carry as much as seventy pounds of mail in these mail bag structures.

These known shoulder-carried mail bags have a number of drawbacks. The strap is abrasive to the shoulder, back, and chest of the person carrying the mail bag. This problem is emphasized as more and more women are becoming mail carriers. Another problem with shoulder-carried mail bags is they cause a concentrated and heavy burden on the shoulder. This problem is also emphasized as more women become mail carriers because women, typically, have narrower and weaker shoulders than do men. A further problem associated with shoulder-carried mail bags is that the weight of the load carried being applied to the shoulder results in the load being carried much above the center of gravity of the person carrying the bag. Mail carriers must do much walking and bending. The heavy load supported on the shoulder much above the center of gravity of the person results in undue stress applied to the back muscles and attendant back injuries. Yet, a further drawback with known shoulder-carried mail bags is that they limit the freedom of movement of the upper body of the person carrying the mail bag.

Various types of carriers attachable at the human waist are known, per se, from for example the following U.S. Patents.

U.S. Pat. No. 2,317,176, issued on Apr. 20, 1943 shows a bag for carrying light-weight items such as, for example, knitting and sewing supplies. The bag is formed of a small, flat pouch formed by folding a sheet of fabric and stitching the side edges together. A zipper is secured to the free edges of the folded sheet of material to form a closable top opening into the pouch. A flexible apron is attached to the top edge of the pouch next to the zipper, and a light-weight belt is affixed to the top edge of the apron.

U.S. Pat. No. 3,055,566, issued on Mar. 2, 1959 for a berry box carrier, that is a box for berry boxes. The carrier includes an open rigid structure adapted for slidably receiving berry boxes. A curved, rigid brace is affixed to the open work structure and projects outwardly therefrom and is adapted to fit against the curvature of the human body. A flexible belt is attached to the projecting ends of the curved brace to secure the carrier to a person's waist.

U.S. Pat. No. 3,917,134, issued on Nov. 4, 1975 shows what is called a fishing carrier for carrying fishing tackle and accessories to be worn about the waist. The carrier is fabricated of a rigid material and includes two box-like compartments having pivoted covers. The box shaped compartments have planar walls and are located side-by-side and in at an angled relationship to each other. An apron plate of rigid material is attached to the box shaped containers spanning the distance across the angle formed between the containers. A belt is attached to the end walls of the containers. When a user is carrying the fishing carrier, the apron plate bears against the user's body to stabilize the carrier relative to the user's body, and the belt is fastened around the user's waist.

U.S. Pat. No. 4,029,243, issued on June 14, 1977 shows a belt supported backpack of unitary construction to be worn around a person's waist for carrying camping supplies and the like. The backpack includes a compartment attached to the intermediate section of a belt in a unitary construction in which the intermediate section of the belt forms the back wall of the compartment which is against the person's body when wearing the backpack. The belt is worn about the person's waist thereby securing the backpack in place. The compartment has a flap which is secured in a closed position by a zipper. The compartment walls and belt are made of the same fabric material.

U.S. Pat. No. 4,287,971, issued on Sept. 8, 1981 shows a bag having a shoulder strap for supporting the bag over a person's shoulder and an auxiliary belt to be worn about the person's waist to reduce the tendency of the bag to swing when suspended from the shoulder.

Each of these above-mentioned bags is suited for particular purposes, all of these bag structures have deficiencies which render each of them unsuited for carrying heavy loads, such as mail, about a person's waist.

SUMMARY OF THE INVENTION

The present invention recognizes the hereinabove discussed drawbacks of the shoulder supported mail bag structure as well as the deficiencies of the bag structures of the U.S. Patents described above. The present invention provides a mail bag structure which overcomes these drawbacks and deficiencies and allows ready access to the contents of the bag.

More particularly, the present invention provides a mail bag structure adapted to be supported at a person's waist comprising a container for mail having a front wall, spaced apart end walls interconnecting the front and back walls, a floor, and an open top defined by the top edges of the front wall, back wall and end walls, a belt adapted to be attached to the mail container and releasably wrap around the waist of a person to carry the container, and belt attachment means on the back wall of the container for removably attaching the belt to the back wall with the longitudinal axis of the belt substantially parallel to the top edge of the back wall, and with the length of the belt attached to the back wall being less than the length of the back wall.

BRIEF DESCRIPTION OF THE DRAWINGS

Advantageous features of the present invention will become even more clear upon reference to the following description and in conjunction with the accompanying drawings wherein like numerals refer to like parts throughout the views and in which.

DETAILED DESCRIPTION

Figure 1:
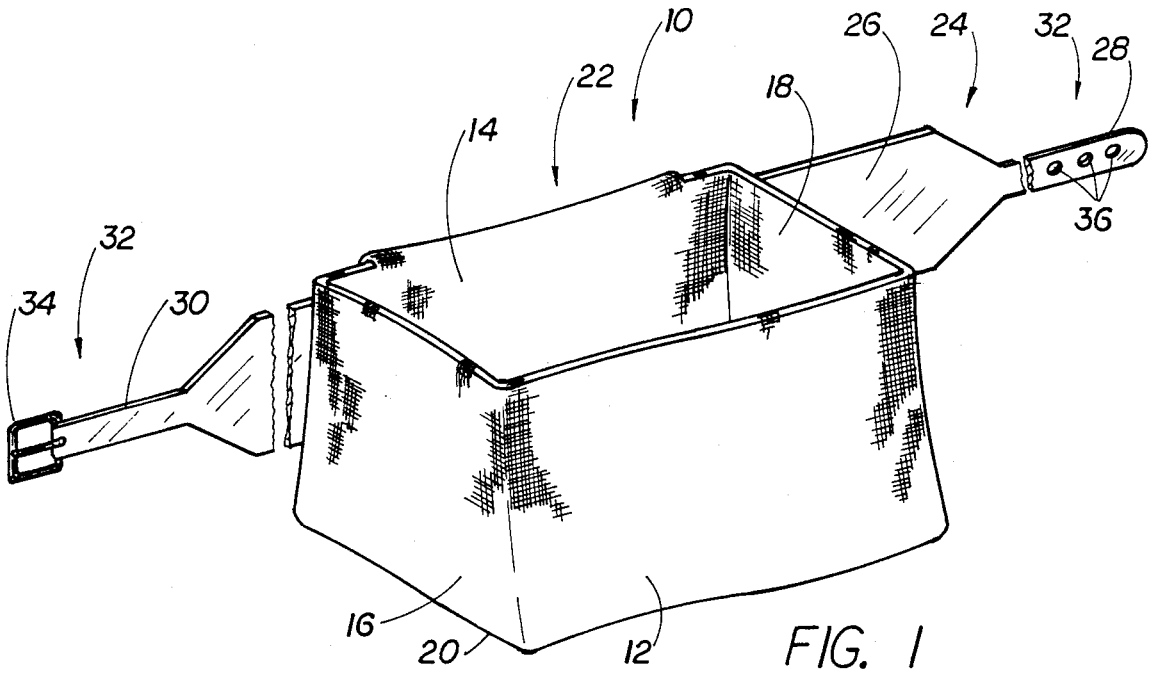
FIG. 1 is a perspective view of the mail bag structure of the present invention.

With reference to FIG. 1, there is shown a mail bag structure, generally denoted as the numeral 10, for carrying mail. The mail bag structure 10 includes a container for the mail comprised of a front wall 12, a back wall 14 spaced from the front wall 12, spaced apart end walls 16 and 18 interconnecting the front and back walls, and a floor 20. The container has an open top, generally denoted as the numeral 22, defined by the top edges of the front wall 12, back wall 14, and end walls 16 and 18. Preferably, the walls of the container are fabricated of a heavy, flexible fabric such as, for example, canvas.

Figure 2:
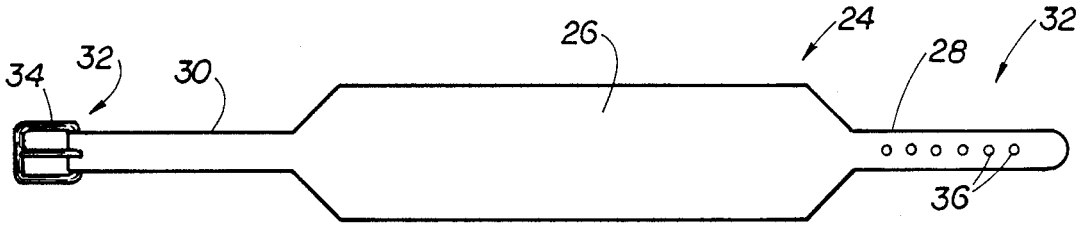
FIG. 2 is a view of the belt component of the mail bag structure of FIG. 1.

Now turning to FIG. 2, there is shown a belt 24 of the mail bag structure 10. The belt 24 comprises a middle section 26 and two end sections 28 and 30 extending away from opposite ends of the middle section 26. The middle section 26 is substantially wider than the end sections 28 and 30. The middle section 26 and end sections 28 and 30 are integrally formed. The middle section 26 is longer than the length of the back wall 14 of the bag structure. By way of illustration, the middle section 26 can be about 26 inches long and 6 inches wide, while the end sections can be 11 inches long and about 2 inches wide. Fastener means, generally denoted as the numeral 32, is associated with the narrower end sections 28 and 30 of the belt for releasably fastening the free ends of the narrower sections 28 and 30 together. The fastener means 32 can be of virtually any conventional or otherwise convenient type, such as for example, a buckle 34 attached to the free end of one of the end sections 28 having a tongue which is received in a selected one of a plurality of holes 36 in the other end section 30.

Figure 3:
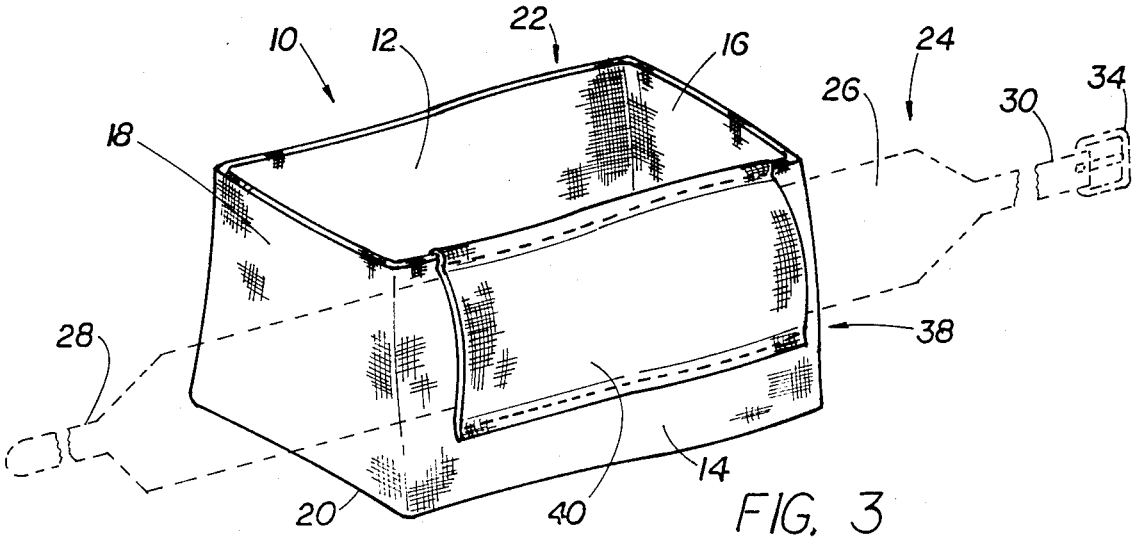
FIG. 3 is a view of the back wall of the mail bag structure of FIG. 1 illustrating one advantageous embodiment for attaching the belt of FIG. 2 thereto.

With reference to FIG. 3, there is shown one advantageous embodiment of means 38 for attaching the belt of FIG. 2 to the container back wall 14. The belt attachment means 38 includes a sleeve 40 affixed to the container back wall 14 and extending across the container back wall 14 generally parallel to the top edge of the back wall 14. As shown, the top edge of the sleeve 40 is integral with the container. More particularly, the sleeve 40 is shown as being formed of a flap of material folded over the container back wall 14 and stitched to the back wall 14. This feature makes the sleeve 40 very strong. The sleeve 40 is slightly wider than the width of the middle section 26 of the belt 24 and is adapted to receive the middle section 26 of the belt 24. The sleeve 40 is generally centered on the longitudinal centerline of the container back wall 14 and is shorter than the length of the container back wall 14. Furthermore, the sleeve 40 is spaced a short distance from the top edge of the container back wall 14. The sleeve 40 is shown as being fabricated of a separate piece of material from the container back wall 14 and being attached thereto by, for example, stitching.

Figure 4:
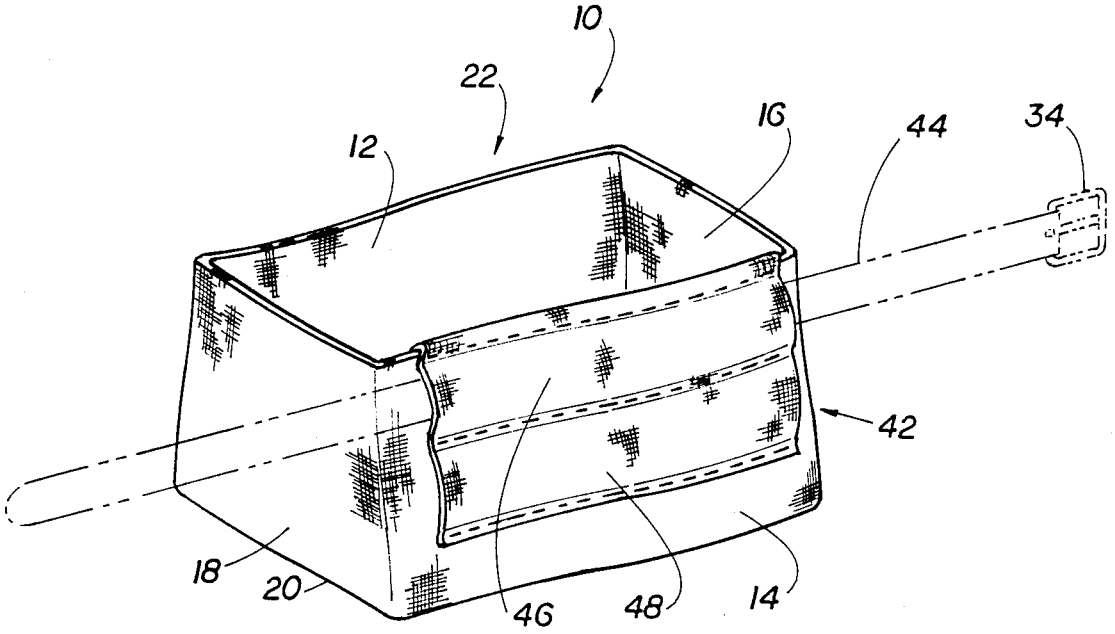
FIG. 4 is a view of the back wall of the mail bag structure of FIG. 1 illustrating another advantageous embodiment for attaching the belt of FIG. 2 thereto.

Now with reference to FIG. 4, there is shown another embodiment of means 42 for attaching a belt 44 to the container back wall 14. As shown in broken lines, the belt 44 is of one continuous width. The attachment means 42 is shown as being two, parallel sleeves 46 and 48 affixed to the container back wall 14 and extending across the container back wall 14 generally parallel to the top edge of the back wall 14. As shown, the sleeves 46 and 48 are formed of a flap of material integral with the top edge of the container back wall 14 and folded over the container back wall 14. The flap is stitched to the container back wall 14 and divided longitudinally by longitudinal stitches to form the two sleeves 46 and 48. However, it should be clearly understood that the belt attachment means 42 can be adapted to attach the belt 24 to the container back wall 14 by merely increasing the width of the sleeves 46 and 48 to an appropriate dimension to receive the middle section 26 of the belt 24. The sleeves 46 and 48 are generally centered on the longitudinal centerline of the container back wall 14 and are shorter than the length of the container back wall 14. Furthermore, the top one of the sleeves 46 is spaced a short distance from the top edge of the container back wall 14. The sleeves 46 and 48 are shown as being integrally formed with each other from a separate piece of material from the container back wall 14 and being attached thereto by, for example, stitching. The two parallel sleeves 46 and 48 allow the wearer of the bag structure 10 to adjust the height of the container open top 22 relative to the wearer's waist.

Figure 5:
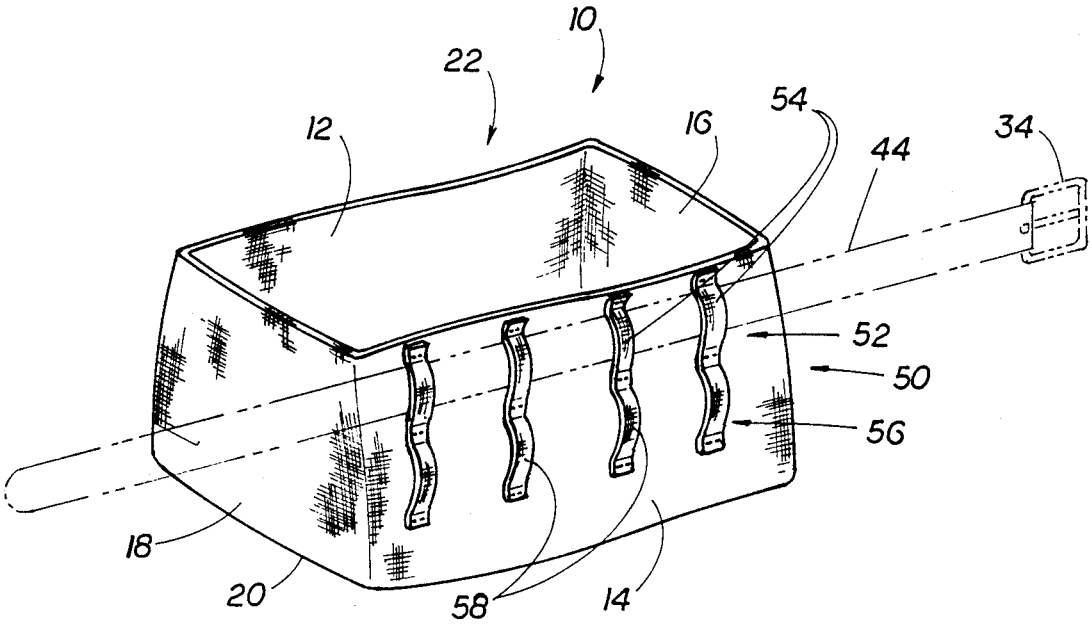
FIG. 5 is a view of the back wall of the mail bag structure of FIG. 1 illustrating still another advantageous embodiment for attaching the belt of FIG. 2 thereto.

FIG. 5 shows yet another embodiment of means 50 for attaching the belt 44 to the container back wall 14. The belt attachment means 50 is shown as comprising a first row 52 of plurality of spaced apart belt loops 54 along the length of the contaienr back wall 14. The distance between the end-most loops 54 is less than the length of the container back wall 14. As illustrated, the belt attachment means 50 also includes a second row 56 of a plurality of spaced apart belt loops 58 along the length of the container back wall 14. The distance between the end-most loops 58 is less than the length of the container back wall 14. The second row 56 of loops 58 is located below the first row 52 of loops 54 with each one of the loops 58 in alignment with a different one of the loops 54. The two parallel rows 52 and 56 of the belt loops allow the wearer of the bag structure 10 to adjust the height of the container open top 22 relative to the wearer's waist. It should be clearly understood that the belt attachment means 50 can be adapted to attach the belt 24 to the container back wall 4 by merely increasing the width of the belt loops 54 and 58 to an appropriate dimension to receive the middle section 26 of the belt 24.

Figure 6:
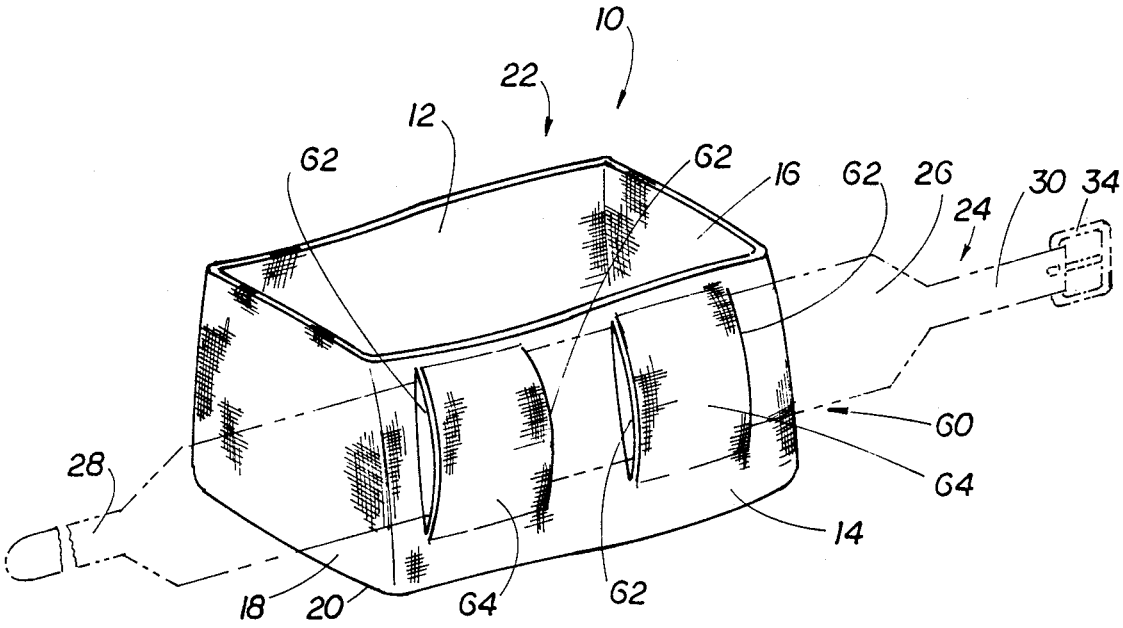
FIG. 6 is a view of the back wall of the mail bag structure of FIG. 1, illustrating yet another advantageous embodiment for attaching the belt of FIG. 2 thereto.

Now turning to FIG. 6, there is shown yet another embodiment of means 60 for attaching the belt 24 to the container back wall 14. The belt attachment means 60 is shown as comprising a plurality of parallel, spaced apart slits 62 formed through the container back wall 14 generally perpendicular to the top edge of the container back wall 14. The opposite end-most two slits 62 are equally spaced from the container end walls 16 and 18. The slits 62 define belt receiving loops 64 defined between adjacent pairs of slits 62 integrally formed with the container back wall 14.

Figure 7:
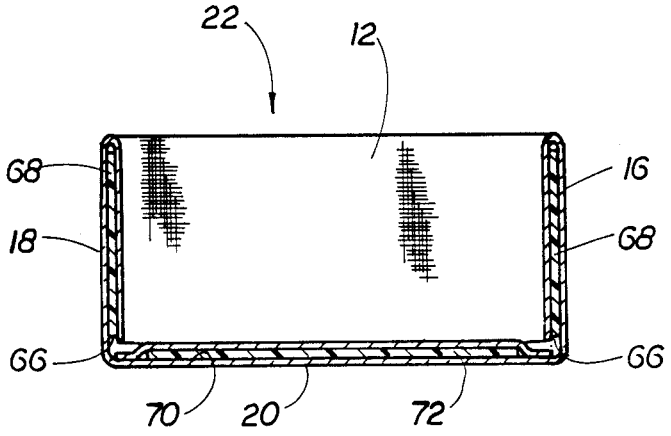
FIG. 7 is a cross-sectional view of the bag structure showing some structural details.

FIG. 7 illustrates some features of the container of the bag structure 10. As shown, the end walls 16 and 18 are formed with pockets 66 which receives reinforcement panels 68 coextensive with the end walls. In addition, the container floor 20 is also formed with a pocket 70 which receives a reinforcement panel 72 coextensive with the container floor 20. Preferably, the reinforcement panels 68 and 70 are fabricated to a water resistant material such as, for example, plastic.

What is claimed is:

1. A mail bag structure adapted to be supported at a person's waist, comprising:

a container for the mail having a front wall, a back wall spaced from the front wall, spaced apart end walls interconnecting the front and back walls, a floor, and an open top defined by the top edges of the front wall, back wall and end walls;

a belt adapted to releasably wrap around the waist of a person to carry the container; and belt attachment means on the back wall of the container for removably attaching the belt to the container back wall with the longitudinal axis of the belt substantially parallel to the top edge of the container back wall and with the portion of the length of the belt attached to the container back wall being less than the length of the container back wall, said belt comprising a relatively wide middle section and two narrower end sections extending away from opposite ends of the middle section, with just the middle section of the belt being attached to said belt attachment means, and fastener means being associated with the narrower end sections for releasably and adjustably fastening the free ends of the narrower end sections together.

2. The mail bag structure of claim 1, wherein said belt attachment means attaches only a portion of the middle section of the belt to the container back wall.

3. A mail bag structure adapted to be supported at a person's waist, comprising:

a container for the mail having a front wall, a back wall spaced from the front wall, spaced apart end walls interconnecting the front and back walls, a floor, and an open top defined by the top edges of the front wall, back wall and end walls;

a belt adapted to releasably wrap around the waist of a person to carry the container; and belt attachment means on the back wall of the container for removably attaching the belt to the container back wall with the longitudinal axis of the belt substantially parallel to the top edge of the container back wall and with the portion of the length of the belt attached to the container back wall being less than the length of the container back wall, said belt attachment means comprising a sleeve adapted to longitudinally receive the belt therethrough, said sleeve being affixed to the container back wall and extending across the container back wall generally parallel to the top edge of the back wall a distance less than the length of the container back wall, said belt comprising a relatively wide middle section and two narrower end sections extending away from opposite ends of the middle section, and fastener means associated with the narrower end sections for releasably and adjustably fastening the free ends of the narrower end sections together and the sleeve being shorter than the middle belt section and being adapted to receive the middle belt section therein for attaching the belt to the container.

4. A mail bag structure adapted to be supported at a person's waist, comprising:

a container for the mail having a front wall, a back wall spaced from the front wall, spaced apart end walls interconnecting the front and back walls, a floor, and an open top defined by the top edges of the front wall, back wall and end walls;

a belt adapted to releasably wrap around the waist of a person to carry the container; and belt attachment means on the back wall of the container for removably attaching the belt to the container back wall with the longitudinal axis of the belt substantially parallel to the top edge of the container back wall and with the portion of the length of the belt attached to the container back wall being less than the length of the container back wall, said belt attachment comprising a plurality of spaced apart belt receiving loops affixed to the container back wall in general alignment with each other parallel to the top edge of the container back wall, with the end-most loops being spaced inwardly from the container end walls, and said belt comprising a relatively wide middle section and two narrower end sections extending away from opposite ends of the middle section, and fastener means associated with the narrower end sections for releasably and adjustably fastening the free ends of the narrower end sections together and the distance between the end most loops of the plurality of belt loops being less than the length of the middle belt section, with the loops being adapted to receive the middle belt section therethrough for attaching the belt to the container.

5. A mail bag structure adapted to be supported at a person's waist, comprising:

a container for the mail having a front wall, a back wall spaced from the front wall, spaced apart end walls interconnecting the front and back walls, a floor, and an open top defined by the top edges of the front wall, back wall and end walls;

a belt adapted to releasably wrap around the waist of a person to carry the container; and belt attachment means on the back wall of the container for removably attaching the belt to the container back wall with the longitudinal axis of the belt substantially parallel to the top edge of the container back wall and with the portion of the length of the belt attached to the container back wall being less than the length of the container back wall, said belt attachment means comprising a plurality of parallel, spaced apart slits formed through the container back wall generally perpendicular to the top edge of the container back wall, the opposite end-most two slits being inwardly spaced from the container end walls, said belt comprising a relatively wide middle section and two narrower end sections extending away from opposite ends of the middle section, and fastener means associated with the narrower end sections for releasably and adjustably fastening the free ends of the narrower end sections together and the distance between the end-most slits of the plurality of slits being less than the length of the middle belt section, with the slits being adapted to receive the middle belt section therethrough for attaching the belt to the container.

6. The mail bag structure of claim 1, wherein the container is fabricated of a cloth.

7. The mail bag structure of claim 6, wherein the container further comprises flexible reinforcement panels associated with the container end walls and coextensive with the container end walls.

8. The mail bag structure of claim 7, wherein:

the end walls are formed with pockets, and the reinforcement panels are received in the pockets.

9. The mail bag structure of claim 6, wherein the container further comprises a flexible reinforcement panel associated with the container floor and coextensive with the container floor.

10. The mail bag structure of claim 9, wherein:

the container floor is formed with a pocket; and the reinforcement panel is received in the pocket.

* * * * *